US006097014A

United States Patent [19]

Kirsch

[11] Patent Number: 6,097,014

[45] Date of Patent: Aug. 1, 2000

[54] APPARATUS AND PROCESS FOR DELIVERY OF PREPARED FOODS

[75] Inventor: Norbert Kirsch, deceased, late of Luxembourg, Luxembourg, by Marie Kirsch, legal representative

[73] Assignee: Florinius-Investimentos E Servicos Internacionais LDA, Portugal

[21] Appl. No.: 08/922,912

[22] Filed: Sep. 3, 1997

(Under 37 CFR 1.47)

Related U.S. Application Data

[63] Continuation-in-part of application No. 08/715,781, Sep. 19, 1996, abandoned, which is a continuation of application No. 08/378,970, Jan. 26, 1995, abandoned.

[30] Foreign Application Priority Data

Feb. 2, 1994 [FR] France ..... 94 01156

[51] Int. Cl.[7] ..... H05B 6/12

[52] U.S. Cl. ..... 219/621; 219/622; 219/634; 99/DIG. 14; 312/236

[58] Field of Search ..... 219/621, 622, 219/634, 676; 99/451, DIG. 14; 312/236

[56] References Cited

U.S. PATENT DOCUMENTS

| | | | |
|---|---|---|---|
| 3,745,290 | 7/1973 | Harnden, Jr. et al. | 219/621 |
| 3,777,094 | 12/1973 | Peters, Jr. | 219/621 |
| 4,020,310 | 4/1977 | Souder, Jr. et al. | 219/622 |
| 4,646,935 | 3/1987 | Ulam | 219/621 |
| 4,776,386 | 10/1988 | Meier | 312/236 |

*Primary Examiner*—Philip H. Leung
*Attorney, Agent, or Firm*—Thomas S. Baker, Jr.

[57] ABSTRACT

Apparatus and process for reheating a meal including a plurality of prepared foods, each food being placed on a dish and the dishes constituting the meal being placed on a tray. Those food dishes to be reheated are placed in insulated receptacles having a magnetic material adapted to be induction heated.

2 Claims, 3 Drawing Sheets

APPARATUS AND PROCESS FOR DELIVERY OF PREPARED FOODS

CROSS-REFERENCES

This Application is a continuation-in-part of Continuation Application Ser. No. 08/715,781 filed Sep. 19, 1996 which in turn is a continuation of application Ser. No. 08/378,970 filed Jan. 26, 1995 both now abandoned.

FIELD OF THE INVENTION

The present invention relates to a meal distribution system, and particularly to a process for delivering a meal consisting of a plurality of prepared foods presented on plates that are randomly placed on a tray, some of which are to be reheated and the others of which are not, and apparatus for its implementation.

BACKGROUND OF THE INVENTION

Nowadays, meals served outside the home, i.e. in canteens, clinics, care establishments etc., may be delivered and prepared in two ways. The meals are prepared either by an outside or an inside catering service.

The meals may be delivered to the place of consumption in two different states: i.e. cold followed by reheating either by induction or conduction—forced air—microwave—bain marie, or with the contents separate or maintained at temperature, in which case the temperature of the delivery may amount to +4 degrees C. or −2 degrees C.; or delivered hot on an insulated tray.

In the case of cold food distribution, the meals are prepared and presented on trays in a transport trolley which may also serve as a reheating trolley. This trolley is then transported in a refrigerated condition to the place of consumption where the meals are reheated.

In the case of hot food distribution, the meals are prepared and presented on trays, which may either be insulated (to keep hot and cold for an hour and a half) or a standard tray used in conjunction with insulated products which keep the food at correct temperature for three-quarters of an hour (base and cloche). The trays are then placed in a trolley and delivered as quickly as possible.

In the case of the hot food system using standard trays in conjunction with isothermal products, the meals cannot be prepared long in advance (not more than three-quarters of an hour). The consumption of meals must not be delayed. This system allows flexible presentation of the trays.

In the case of the cold food system to be reheated by induction, the heating is carried out by a hotplate underneath the dish. This method often results in the food at the bottom of the dish being burned and the food above it being poorly reheated. There also has to be holes in the tray, i.e. a special tray is required. Additionally, there must be a special place on the tray for heating a plate and a bowl of soup, which means that trays must be identical. If the reheating trolley is also the transport trolley, this means that it is very heavy, very expensive and very fragile. Special meals (which must remain cold) cannot be placed on the same trolley, as everything will be heated by the hotplates located underneath the dishes. The trolley must be used with care and be well maintained because the heating trolley is also used for transport. This is a very costly system and as many trolleys with hotplates are required as the number of meals served. The heating time varies between 30 and 45 minutes.

In the cold food system the existing heating system by means of induction is fragile as the inductors are located in the transport trolley. A silver disc is fixed to the base of each plate to be reheated. However, this requires two stocks of plates: one for hot dishes and one for cold dishes. There is a hot zone and a cold zone on the trays, and hence no flexibility. This system is expensive because the reheating trolley is also the transport trolley. Handling must be carried out with care because the inductors are frequently touched during handling of the trays. Moreover, the transport trolley is very heavy.

SUMMARY OF THE INVENTION

The aim of the invention is to create a system for heating meals, which does not have the disadvantages of presently known systems, as well as apparatus for its implementation.

This aim is achieved according to the invention by a process for reheating a meal consisting of a plurality of prepared foods presented on dishes randomly placed on a tray and only some of which contain a food that is to be reheated, characterized in that only each dish containing a food to be reheated is packed in an insulated special receptacle having an included magnetic material, and that the tray on which the dishes are presented is exposed to an electromagnetic field that is essentially of uniform strength throughout the entire plan area of the tray. The magnetic material in the special receptacle is subsequently inductively heated by the electromagnetic field, and in turn reheats the food in the receptacle either by conduction and/or by radiant heat.

According to the invention, the receptacle for implementing the process comprises a hollow base made of an insulating material, a cloche made of insulating material to fit the base and a plate of magnetic material inserted either in the base or in the cloche.

According to the invention, the apparatus for implementing the process comprises a closed chamber, a generator of medium- or high-frequency current, which may be connected to a source of electrical energy, an inductor means located in said closed chamber and connected to the outlet of said generator, and a support means to receive the tray and to expose it to the electromagnetic field generated by said inductor. Importantly, the inductor means of the closed chamber creates electromagnetic fields that are each coextensive in its plan area to the plan area of the tray that bears the randomly placed prepared food dishes, normally including both dishes in the special receptacles that are to be reheated and dishes not contained in special receptacles, and that co-operates with the electromagnetic field.

The invention will now be described on the basis of a nonrestrictive example with reference to the attached drawings.

DETAILED DESCRIPTION

Figure 1:
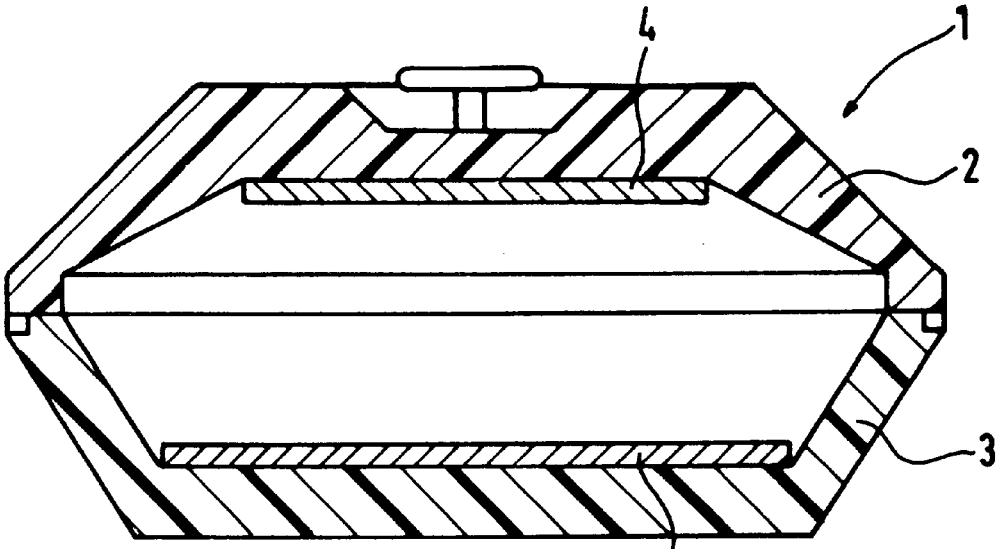
FIGS. 1 and 2 show a schematic sectional view of a receptacle for implementing the process, FIG. 2 also showing a food to be reheated.
Figure 2:
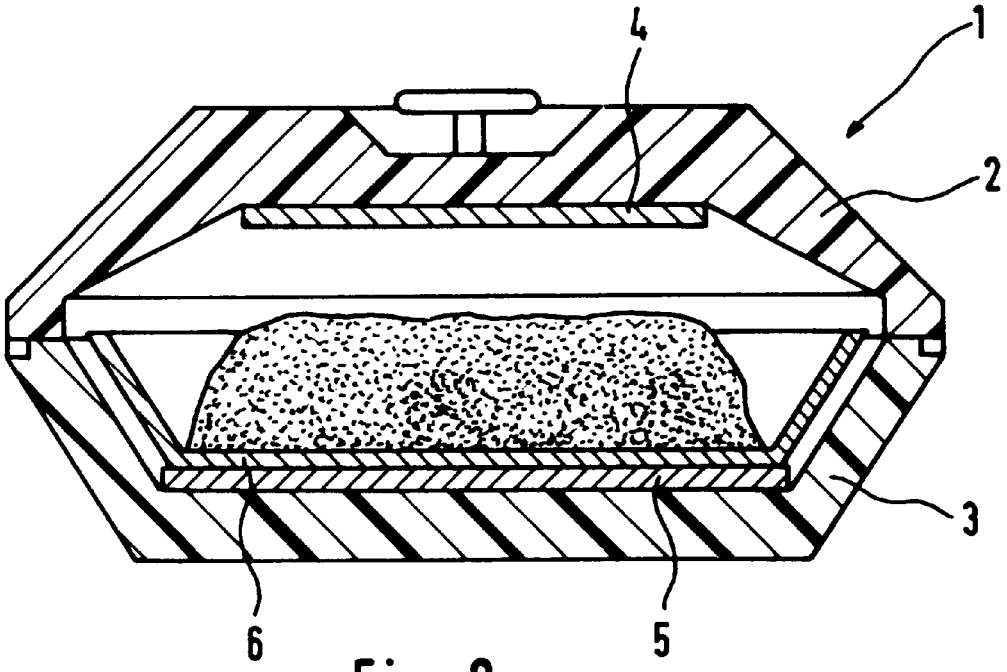

In the system for distributing and selectively reheating meals from cold, the meals are prepared and packed cold at plus temperatures (+4 degrees C.) or minus temperatures (−20 degrees C.) in an outside catering service or in an in-house kitchen. They are then presented on trays 17 placed on a standard transport trolley 16 for carrying trays kept at +4 degrees C. The dishes to be reheated are packed into containers 1 (system with insulated cloche 2 and base 3) insulated with polyurethane foam or other material shown in FIGS. 1 and 2. Two metal plates 4 and 5 made of magnetic steel are inserted in the insulated containers 1, one of which 4 being inserted into the cloche 2, the other 5 into the base 3. The magnetic steel plates 4, 5 are heated when exposed to sufficient electromagnetic radiation by contact from below or by radiation from above. It is, of course, also possible to provide only one metal plate 4 or 5 in the cloche or the base. However, insertion of a plate 4 underneath will prevent water condensation in the cloche 2.

Figure 3:
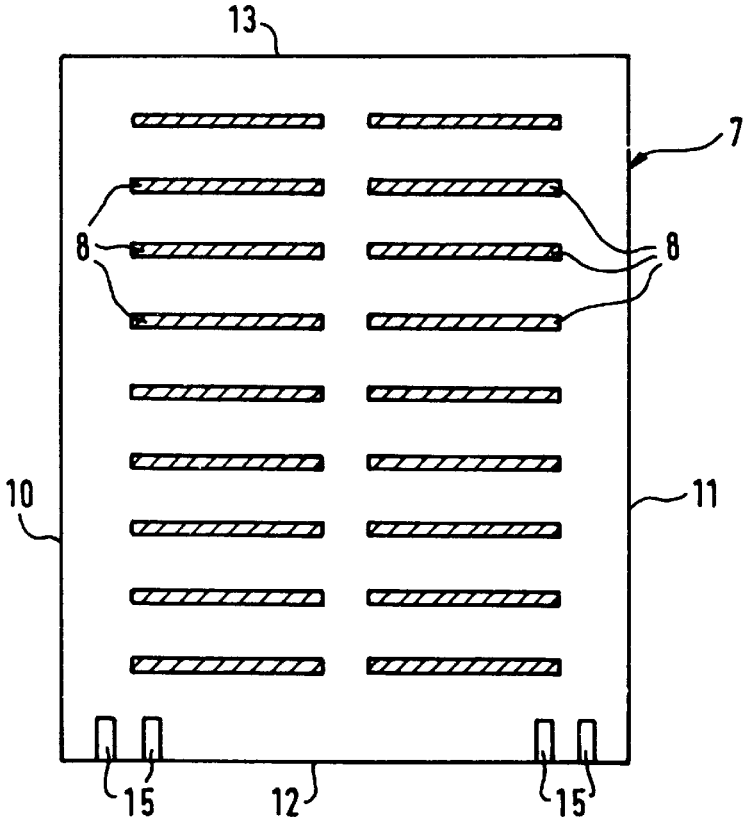
FIGS. 3 and 4 show a schematic representation of the apparatus for implementing the process in a front view and a side view with the side wall removed.
Figure 4:
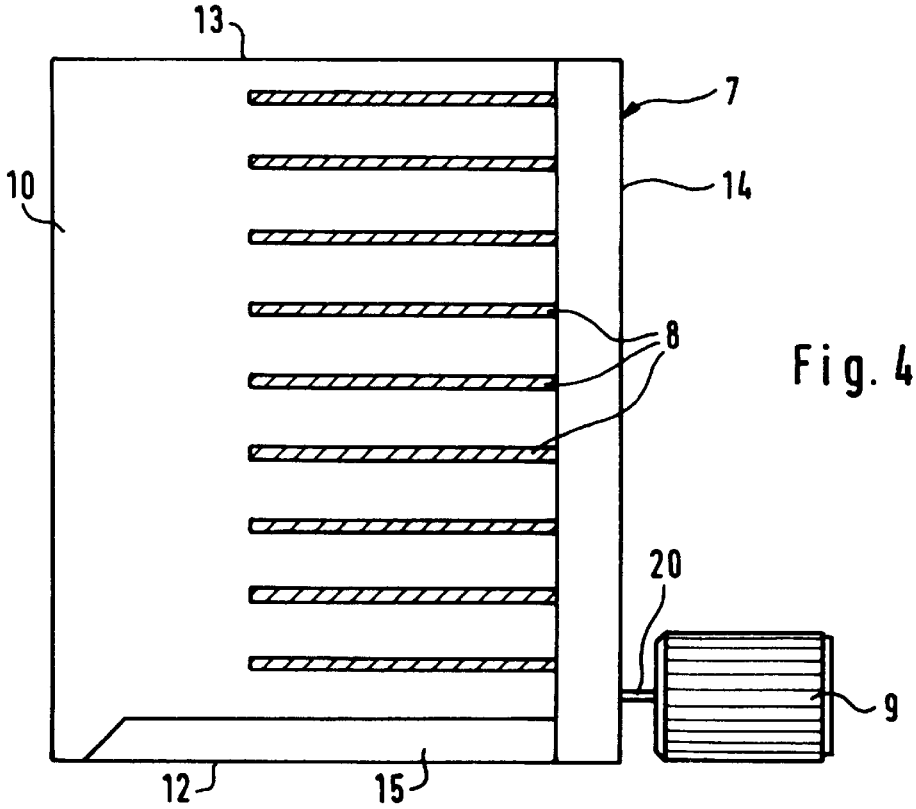
Figure 5:
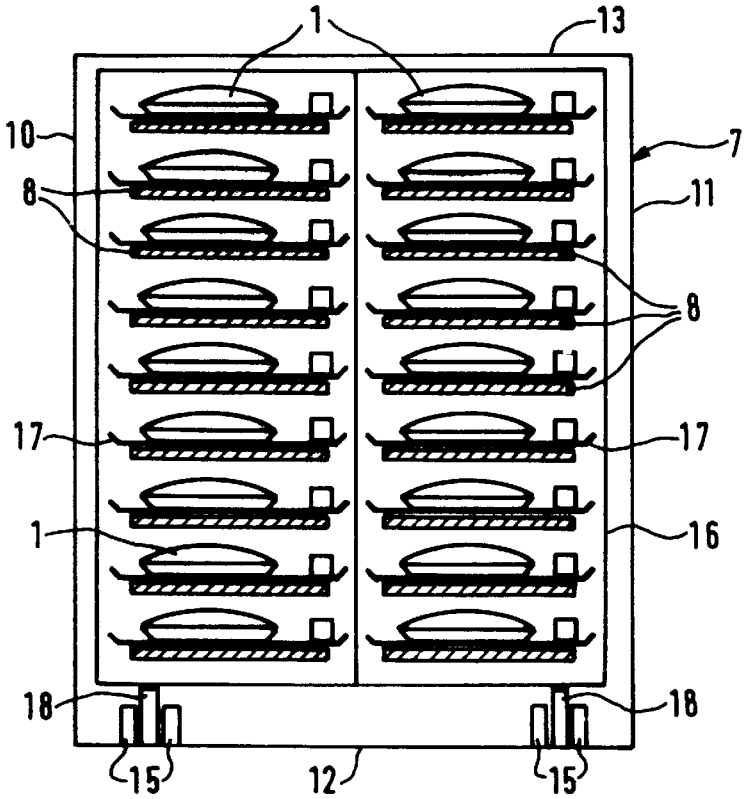
FIGS. 5 and 6 show a schematic representation of the apparatus according to FIGS. 3 and 4 including a trolley carrying trays bearing meals to be reheated.
Figure 6:
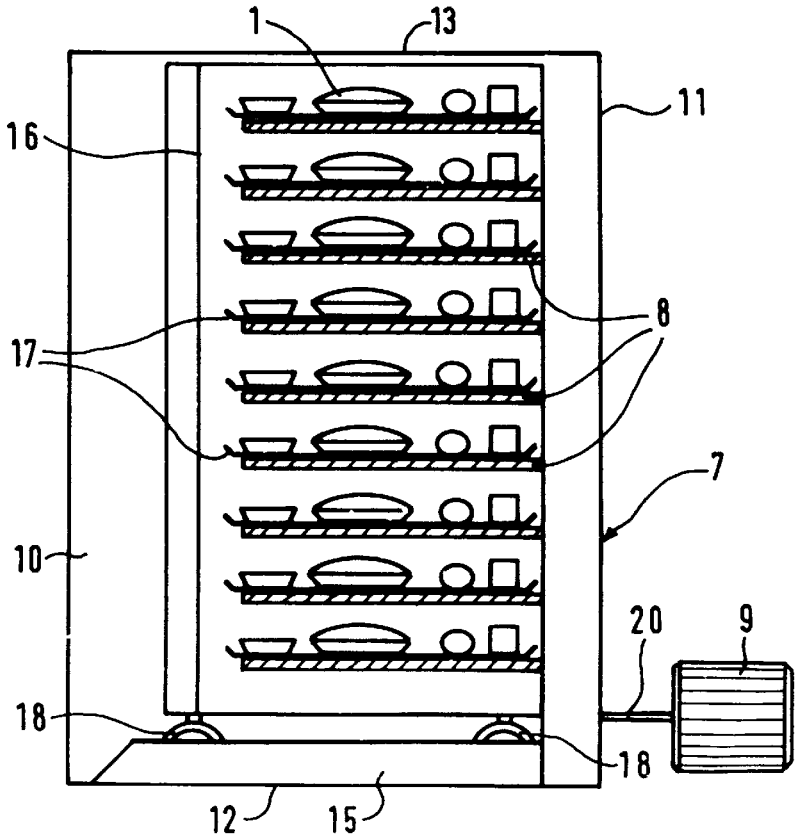

The trolley 16 loaded with trays 17, each carrying a meal, is transported to the place of consumption. It is then kept in a store until one hour before the meals are to be served. One hour or half an hour before distribution of the meals, the trolley or trolleys 16 are placed for reheating in an induction chamber 7, which is installed in a fixed location, as shown in FIGS. 3 and 4.

The doors of the chamber 7 are opened and the transport trolley 16 is placed in the chamber. The inductors 8, which are disposed in one or several adjacent rows one above the other, are automatically placed beneath the trays 17 without touching them and will reheat the foods to be heated without the trays 17 being handled after actuation of a generator 9 of medium- or high-frequency current, at the outlet of which they are connected by appropriate heat conductors 10 connected by various inductors 8. Each inductor 8 produces an electromagnetic field that has a flux density that is uniform throughout a plan area which is co-extensive with the plan area of the tray 17 that co-operates with it. Also, each tray 17 has a flat or even surface configuration throughout its dish-supporting plan area so as to accommodate a random placement of dishes on that surface.

The food will be reheated in approximately 10 to 20 minutes. The heat absorbed by the plate and the foam insulation or other material will increase the time the temperature of the meals is maintained at 65 degrees C. After approximately 20 minutes, reheating is stopped and the chamber 7 opened. The transport trolley 16 is then removed and the meals served. The foods remain hot for 1 hour because the cloche 2 and the base 3 enclose the dish 6 and because of the metal inserts 4, 5.

The chamber 7 is a closed chamber with two side walls 10, 11, a base 12, a ceiling 13, a rear wall 14 and one or several doors (not shown) hinged to the chamber to close it at the front. Several guide tracks are provided on the base of the chamber to guide the wheels 18 of the transport trolley 16 for carrying trays into the chamber 7.

The spacing of the inductors 8 in each row is such that the trays on the transport trolley 16 are each placed above or below the respective inductor. The dimensions of the inductors 8 are adapted to the dimensions of the trolley used. If there are several rows of inductors 8, they are spaced horizontally in accordance with the dimensions of the trolley used, the number of which may be equal to the number of rows of inductors 8. A chamber 7 may be provided with non-detachable support means instead of the detachable support means or trolley 16 described.

Obviously, the materials used to produce the trolley, trays and chamber must be non-magnetic to prevent their being heated and to prevent wastage of energy. Moreover, it is obvious that operation of the inductors must not have a detrimental effect on the operation of other adjacent devices and that standards must be complied with in this regard.

The apparatus may simply comprise one inductor for heating one dish. Obviously in this case, however, the transport trolley may be replaced by a support means fixed in the chamber, e.g. two tracks to receive the tray, or a movable means like a trolley. The number of inductors 8 in a row as well as the number of rows are determined by the intended use of the chamber. The same applies to the number of access doors to the chamber.

Any standard transport trolley for carrying trays may be used. The spacing between the trays must obviously be in keeping with the spacing between the inductors 8.

There are many advantages of the process for reheating a meal according to the invention:

1—Standard equipment may be used:

Standard crockery, standard tray, standard transport trolley, etc., all non magnetic.

2—Reduced handling:

Presentation: the entire meal is already on the tray.

Reheating: the trolley is placed in a fixed reheating chamber.

Delivery: the arranged trays are already in the transport trolley.

The trays are not touched from the time the trolleys are delivered to the place of consumption to the time they are served to the customers.

3—Reduced time for reheating: only about 20 minutes.

4—Improvement in quality of reheating: no burning to the bottom of the dish (problem with the conduction method).

5—Increase in time heat is conserved:

The cloche and the base keep in the heat as do the metal plates inserted in the cloche and the base.

6—Reduction in weight of transport trolley compared to that of the existing heating system (induction and conduction):

Heating takes place in a fixed chamber because a standard trolley is used without electrical fittings.

7—Reduced cost of transport trolley:

A standard trolley is used.

8—Maintenance of trolley virtually non-existent because it has no electrical fittings.

9—Multiple use of the trolley:

The transport trolley may be used for different deliveries, cold meals, drinks etc.

10—It is possible to have several hot and/of cold dishes on the same tray without restricting the number of hot dishes.

11—It is possible to reheat at any location on the tray:

There is no fixed hot zone and cold zone on the tray.

12—The heating chamber will never be moved, and this reduces the risk of breakdown.

13—One reheating chamber is sufficient for several transport trolleys:

Reduced investment in large equipment.

I claim:

1. In a food delivery method for prepared foods for consumption, some of which are to be reheated and some of which are not to be reheated, the steps of:

packing a first prepared food that is not to be reheated in a non-magnetic dish;

packing a second prepared food that is to be reheated in an insulated dish having a magnetic material insert;

placing said non-magnetic dish and said insulated dish, each with its prepared food contents, on a non-magnetic tray and in random positions within the tray total dish-supporting area;

placing said tray and randomly placed dishes in an electromagnetic field of substantially uniform flux density throughout an inductor plan area that is co-extensive with said non-magnetic tray total dish-supporting plan area; and maintaining said tray and randomly placed dishes in said electromagnetic field a sufficient time to heat said second prepared food indirectly by electromagnetic induction without inductively heating said first prepared food.

2. The food delivery method invention defined by claim 1, wherein said first prepared food is packed in a dish that is also an insulated dish.

* * * * *